US006835255B2

(12) United States Patent
Moser, Jr.

(10) Patent No.: US 6,835,255 B2
(45) Date of Patent: Dec. 28, 2004

(54) REDUCED ENERGY BINDER FOR ENERGETIC COMPOSITIONS

(75) Inventor: John R. Moser, Jr., Salt Lake City, UT (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 09/088,163

(22) Filed: Jun. 1, 1998

(65) Prior Publication Data

US 2002/0020477 A1 Feb. 21, 2002

(51) Int. Cl.[7] ..... C06B 45/10
(52) U.S. Cl. ..... 149/19.4; 149/19.5
(58) Field of Search ..... 149/19.4, 19.5, 149/76

(56) References Cited

U.S. PATENT DOCUMENTS

| | | | | | |
|---|---|---|---|---|---|
| 3,203,842 | A | * | 8/1965 | Godfrey | 149/19.5 |
| 3,362,859 | A | * | 1/1968 | Sutton et al. | 149/19.5 |
| 3,632,632 | A | * | 1/1972 | Hauser et al. | 149/19.5 |
| 3,692,597 | A | | 9/1972 | Brockway et al. | |
| 3,745,076 | A | | 7/1973 | Sickman et al. | |
| 3,956,890 | A | * | 5/1976 | Davis | 60/219 |
| 4,064,079 | A | | 12/1977 | Sidebotham et al. | |
| 4,102,868 | A | * | 7/1978 | Genetti et al. | 528/76 |
| 4,284,442 | A | * | 8/1981 | Voigt, Jr. | 149/19.4 |
| 4,298,411 | A | | 11/1981 | Godsey | |
| 4,298,412 | A | * | 11/1981 | Biddle et al. | 149/19.5 |
| 4,386,978 | A | | 6/1983 | Baczuk et al. | |
| 4,462,848 | A | * | 7/1984 | Elrick | 149/19.92 |
| 4,657,607 | A | | 4/1987 | Perotto et al. | |
| 4,775,432 | A | | 10/1988 | Kolonko et al. | |
| 5,074,938 | A | * | 12/1991 | Chi | 149/19.4 |
| 5,240,523 | A | * | 8/1993 | Willer | 149/19.4 |
| 5,271,778 | A | * | 12/1993 | Bradford et al. | 149/19.5 |
| 5,376,426 | A | | 12/1994 | Harpell et al. | |
| 5,387,295 | A | | 2/1995 | Gibson | |
| 5,468,311 | A | | 11/1995 | Godsey et al. | |
| 5,520,756 | A | | 5/1996 | Zeigler | |
| 5,529,649 | A | * | 6/1996 | Lund et al. | 149/19.3 |
| 5,536,805 | A | * | 7/1996 | Kangas | 528/59 |
| 5,547,526 | A | * | 8/1996 | Wanninger et al. | 149/19.2 |
| 5,583,315 | A | * | 12/1996 | Fleming | 149/19.4 |
| 5,625,162 | A | | 4/1997 | Appleby | |
| 5,694,426 | A | | 12/1997 | McCree et al. | |

FOREIGN PATENT DOCUMENTS

| | | |
|---|---|---|
| EP | 0 194 180 A1 | 9/1986 |
| EP | 0 208 983 A1 | 1/1987 |
| EP | 0 266 973 A2 | 10/1987 |
| EP | 0 266 973 A2 | 5/1988 |
| EP | 0 553 476 A1 | 12/1992 |
| EP | 0 553 476 A1 | 8/1993 |

* cited by examiner

*Primary Examiner*—Aileen Felton
(74) *Attorney, Agent, or Firm*—Nikolai & Mersereau PA; C. G. Mersereau

(57) ABSTRACT

Improved binders for energetic compositions include high molecular weight polyester polyol binder polymers and energetic plasticizers wherein the plasticizer to polymer ratio is 1.6:1 or less.

16 Claims, No Drawings

REDUCED ENERGY BINDER FOR ENERGETIC COMPOSITIONS

BACKGROUND OF THE INVENTION

I. Field of the Invention

The present invention relates generally to energetic compositions or formulations, particularly solid high energy compositions including propellants, explosives, gas generators and the like. More particularly, the invention focuses on improvements for reducing hazards sensitivity and product cost in propellant compositions.

The hazards sensitivity is reduced by substantially reducing the required relative amount of shock sensitive energetic plasticizers, particularly nitrate esters, such as nitroglycerin (NG), by replacing the conventional binder polymer and part of the plasticizer with a binder polymer more easily plasticized.

One important aspect of the invention focuses on the discovery that amounts of relatively high molecular weight polyester prepolymers, particularly polyester polyols, can be combined successfully with surprisingly low levels of energetic plasticizers (particularly nitrate esters) in energetic compositions that are relatively low cost and characterized by comparable or superior mechanical properties. A preferred binder polymer is an isocyanate-cured, high molecular weight polyester diol poly(1,4-butanediol adipate) or poly(tetramethylene adipate) (PTHA). The invention also enables improved formulae in which high cost, relatively sensitive, high energy, energy adjustment compounds, such as cyclic nitramines of fine particle size, including cyclotrimethylene trinitramine (RDX) or cyclotetramethylene tetranitramine (commonly referred to as HMX) can be, if desired, partially or completely replaced by aluminum and ammonium perchlorate (AP) oxidizer and/or other combinations of particulate solids. Such cyclic nitramines of fine particle size are typically used to increase the energetic performance and to improve the mechanical properties of the composition.

II. Related Art

Solid, high energy compositions such as rocket propellants, gas generators, explosives, and the like, generally contain particulate solids in the form of oxidizers, fuels, burning rate modifiers, solid explosives, etc., dispersed in elastomeric binders. The elastomeric binders themselves may contain inert polymer materials, but these compositions may also contain high energy, hazards sensitive plasticizers, such as nitrate esters. These plasticizing materials are known to enhance the mechanical properties as well as the energy output of the overall composition. The typical ratio, by weight of plasticizer to total polymer (including prepolymers, crosslinkers and curatives) in binder materials (commonly known as the Pl:Po ratio) is about 2–4, i.e., 2 to 4 parts of energetic plasticizer to one part of polymer in the binder.

Recently, more stringent requirements imposed for lower hazards sensitivity have led to an increased demand for lower energy, but not entirely inert, binders which have become known as reduced energy or intermediate energy binders. The general approach to developing these binders has been to replace or dilute very high energy plasticizers with lower energy plasticizers while holding the Pl:Po ratio substantially constant at about 2–4.

An alternative approach to this problem which seemed logical was to simply dilute the high energy plasticizers with additional binder polymer material to reduce the overall binder energy as this would provide a more dense polymeric network which, in turn, would be expected to be a great deal tougher and more resistant to physical damage, another critical consideration for reducing hazards sensitivity. It was found, however, that at the resultant lower Pl:Po ratios, the lower fraction of plasticizer was insufficient to properly plasticize the binder polymer and this resulted in unsatisfactory mechanical properties, especially with regard to low elongation. Thus, there has remained a need to solve the problem of fully plasticizing the binder polymer at lower Pl:Po ratios to reduce hazards sensitivity in a manner which preserves good mechanical properties or even enables improvements in mechanical properties.

Crosslinked binders disclosed by Baczuk et al (U.S. Pat. No. 4,386,978) include urethane rubber materials that include certain polyester diols which contain both aliphatic and aromatic ester functions. These are combined with a poly-functional isocyanate having an NCO (isocyanate) functionality of at least 3. Energetic plasticizers are not reduced, however.

Godsey et al (U.S. Pat. No. 5,468,311) discloses a composition having a binder system that includes polyols which may be polyesters or polyethers having a molecular weight from about 400 to about 4,000 and hydroxyl functionalities from about 2.0 to about 2.8. The preferred polyol is polyethylene glycol adipate. The preferred molecular weight range is from about 2,000 to about 3,000. A further patent to Godsey (U.S. Pat. No. 4,298,411) depicts a propellant system that includes a pre-polymer of a hydroxy-terminated polyester and an isocyanate used in very small amounts as a crosslinking agent.

In U.S. Pat. No. 4,775,432 to Kolonko et al, it has further been proposed to use relatively high molecular weight poly(caprolactone) polymers in propellant binders. Those formulae, however, require a ratio of plasticizer to binder that is at least 2.0:1 and preferably at least 2.5:1.

Whereas each of the above references addresses certain previous drawbacks in the art, none predict a low cost, reduced hazards energetic formulation with desired mechanical properties.

Accordingly, it is a primary object of this invention to provide an improved binder system for energetic compositions which maintains excellent mechanical properties, together with reduced hazards sensitivity.

A further object of the invention is to replace an amount of energetic plasticizers in binders for energetic compositions with binder polymers without sacrificing good mechanical properties.

It is another object of this invention to provide an improved binder system for high energy compositions using high molecular weight polyester prepolymers combined with a relatively low level of energetic plasticizer.

Yet another object of this invention is to provide lower cost energetic compositions of reduced hazards sensitivity and desirable mechanical characteristics.

A still further object of this invention is to provide an improved binder system for high energy compositions utilizing isocyanate crosslinked or cured, relatively high molecular weight PTMA pre-polymer as the binder polymer.

Yet still another object of the invention is to provide lower cost energetic materials by replacing part or all of the RDX or HMX fraction with a suitable solid material combination such as AP and aluminum.

Other objects and advantages will become apparent to those skilled in the art upon becoming familiar with the descriptions and accounts contained herein together with the appended claims.

SUMMARY OF THE INVENTION

The present invention overcomes many drawbacks in prior energetic compositions by the provision of improved reduced energy binder compositions for solid, high energy formulations including propellants, explosives, gas generators and related materials, together with formulations using these binders. The binders of the invention are particularly advantageous because they are relatively low cost and exhibit improved hazards properties relative to similar, higher energy binders. In addition, the binders promote excellent mechanical properties which allow additional composition variation leeway which, in turn, can be used to reduce cost and hazards sensitivity still further. The excellent mechanical properties survive in the formulations even without the reinforcement of fine particle size nitramines such as HMX and RDX.

The binders are useful with any commonly used solid energetic species and successfully employ binder polymer materials to replace at least part of the energetic plasticizers thereby reducing the levels of energetic plasticizers, particularly nitrate esters, required in the binder. The binder system of the invention succeeds mechanically at levels of energetic plasticizers that are quite low.

The invention accomplishes the foregoing advantages by providing unique binder compositions that employ a cured high molecular weight polyester matrix, particularly polyester polyols which readily undergo crosslinking curing through active hydroxyl group sites using polyisocyanates in combinations with relatively low levels of energetic plasticizers. The preferred embodiment uses high molecular weight poly(tetramethylene adipate) or PTMA with NG, but other energetic plasticizers such as n-butyl-2-nitratoethyl nitramine (BuNENA), trimethylolethane trinitrate (TMETN), triethyleneglycol dinitrate (TEGDN), butanetriol trinitrate (BTTN) and other materials also function effectively.

The polyester prepolymer materials of the invention are compounds that are readily plasticized by energetic plasticizers including nitrate ester compounds such that the relative level of high energy plasticizer can be reduced significantly. The formulas make use of material that is sufficiently plasticized at low Pl:Po ratios of about 1.0 such that lower hazards sensitivity advantages associated with the higher relative polymer levels can be taken. It has been found, for example, that PTMA of a rather high molecular weight (MW—6,000 in which the MW is a number average molecular weight) works extremely well. When used with NG at an approximate ratio of 1:1, or even slightly less, the polymer is sufficiently plasticized to enable excellent or superior mechanical properties to be realized.

While the detailed description focuses on the use of PTMA, it is believed that other high molecular weight polyester polyol materials having sufficient reactive hydroxyl group sites to react with a crosslinking agent, particularly a polyisocyanate, to form a cured polymer matrix may behave similarly. Thus, linear and moderately branched polyester polyols derived from aliphatic and/or aromatic starting materials, or from polymerizable lactones or mixtures thereof of sufficient molecular weight may function in a similar manner. Examples of other such compounds include poly(1,4-butanediol azelate), poly (diethyleneglycol adipate), poly(1,6-hexanediol adipate), poly(1, 3-butanediol adipate), etc.

The present invention also provides reduced or intermediate energy binder propellant systems of reduced cost and reduced hazards sensitivity which maintain superior mechanical properties. Some formulas reduce both cost and hazards sensitivity by reducing or eliminating RDX or HMX and further reduce hazards sensitivity by utilizing novel, reduced energy binders. In this manner, it has been found, for example, that some or all of the high priced components RDX or HMX can be replaced by less expensive AP oxidizer and aluminum or other solids combinations.

In one example, a 75% solids propellant was prepared which utilized 53% unground (200$\mu$) ammonium perchlorate and 22% aluminum (30$\mu$). That formula also contained 11.3% PTMA of MW approximately 6,200 and 12.19% NG. The propellant gave outstanding mechanical properties and less than 69 cards in NOL card gap testing.

According to the invention, it has also been found that a combination of plasticizers may be used in such formulas including amounts of inert materials to provide further flexibility in formulating useful mixes. An example of such an inert plasticizer is triacetin (TA) or triacetyl glycerine. The use of amounts of inert plasticizer allows a further reduction in the required amount of energetic plasticizer. The percentage of inert plasticizer used may vary greatly in the binder, which itself may vary greatly in the mix. One successful formula used about 2.5% TA and another about 1.4% TA.

As a general comment with respect to many of the ingredients used in the several exemplary formulae disclosed herein, the following is a partial list of ingredient functions in the energetic compositions:

NC—crosslinker
PTMA—prepolymer
N-100, DDI, IPDI—isocyanate curatives
NG, TMETU, BuNENA, etc.—energetic plasticizers
TA—inert plasticizer
2-NDPA, MNA—stabilizers
AP—oxidizer, burn rate modifier
$NaNO_3$—oxidizer, chloride scavenger
DCDA—burn rate suppressant
Al—fuel
TPB—cure catalyst It is expected that a range of molecular weights for the PTMA binder material may be successfully used; however, it has been discovered that using molecular weights that are higher produces surprisingly superior results at low Pl:Po ratios. With PTMA, it is believed that the preferred range of molecular weights of PTMA begins above about 4,000 and preferably above 5,000, material of approximately 6,000 MW or greater is most preferred being found highly successful. The material has allowed the formulation of low-binder-energy propellant that requires no HMX or RDX and so can be made out of lower cost materials.

Another important advantageous characteristic of the binders of the invention is a relatively high electrical conductivity. This is also important with respect to reducing hazards by assisting in preventing the accumulation or buildup of large static charges in the associated energetic compositions.

DETAILED DESCRIPTION

The goals of the energetic formulae or compositions of the present invention are to reduce cost and reduce hazards sensitivities (hazards class 1.3) in energetic compositions including missile propellants. The energetic compositions of the invention use a binder system that includes a high molecular weight polyester polyol (polyester prepolymer) binder polymer and an energetic plasticizer. The invention is based, at least in part, on the discovery that certain higher molecular weight polyols (polyester prepolymer) binder compounds are plasticized in the cured state much more readily than expected by energetic plasticizers to enable the Pl:Po to be reduced to just above 1.0 or even less. These compounds are particularly characterized by attached hydroxyl groups that provide reactive sites that react with crosslinking agents, particularly isocyanates to form the cured polymeric matrix. While the examples of the detailed description particularly disclose PTMA, this is intended to be interpreted as illustrative rather than limiting and many other polyester polyol-type compounds including linear and moderately branched hydroxyl polyester compounds derived from aliphatic and/or aromatic starting materials or from polymerizable lactones may work successfully. In addition, high priced, solid, energy enhancement ingredients such as nitramines including RDX and HMX can be replaced in whole or in part by solid materials such as Al and AP or possibly sodium nitrate ($NaNO_3$).

Thus, the improvement achieved with the present reduced-binder-energy compositions is two-fold: (1) they can be used to reduce hazards sensitivity and cost by enabling partial or total replacement of RDX, HMX, etc., with AP, Al, and/or other solids and (2) they further reduce hazards sensitivity by providing binders that dramatically reduce the required relative amount of energetic plasticizer enabling replacement of some of the energetic plasticizer (NG, TMETN, BuNENA, etc.) with polymer.

As indicated, poly(1, 4-butanediol adipate) or poly (tetramethylene adipate) (PTMA) is the most preferred binder polymer and it may also be identified by Chemical Abstracts Service (CAS) Registry Number 25103-87-1. In accordance with the invention, the required amount of high energy plasticizer such as energetic nitrate esters, particularly NG, can be reduced significantly while attaining as good or even superior mechanical properties. It will be understood that while detailed embodiments described herein are solid propellants typically used as rocket propellants, these are meant by way of example only and are in no way intended to limit the scope of application of the binder materials of the invention.

EXAMPLE 1

A baseline reduced-binder-energy propellant used a 0 cal/g (binder heat of explosion, $HeX_B$) PTMA/NG binder in a 75%-solids propellant shown to give outstanding mechanical properties. That particular formula used all unground 200$\mu$ AP. This formulation is shown in Table I. One-pint-mix properties of this formulation are shown in Table II. Such a formula is suitable for strategic missile propulsion, for example.

This formula is successful in accordance with a preferred embodiment of the invention. High molecular weight (6,000 or higher) PTMA has been found to become sufficiently plasticized at very low Pl:Po ratios (approximately 1:1).

TABLE I

Baseline reduced-binder-energy formulation

| Ingredient | Weight % | | |
|---|---|---|---|
| RS 5 sec NC | 0.06 | Percent Solids | 75 |
| PTMA 6000 | 11.30 | P1:Po | 0.99 |
| N-100 | 0.97 | $Hex_8$ (cal/g) | 0 |
| NG | 12.19 | NC/PTMA | 0.005 |
| 2-NDPA | 0.12 | NCO/OH | 1.3 |
| (2-nitrodiphenylamine) | | theor. $I^0_{sps}$ ($lb_f s/lb_m$) | 260.4 |
| MNA | 0.36 | theor. $\rho$ (g/cc) | 1.84 |
| (N-methyl-p-nitroaniline) | | theor. flame T (° K.) | 3756 |
| AP (200$\mu$) | 53.00 | | |
| Al (30$\mu$) | 22.00 | | |
| TPB | (0.01) | | |

TABLE II

One-pint-mix properties of baseline reduced-binder-energy formulation (using all 200$\mu$ AP, except as noted).

| | |
|---|---|
| **Tensile properties @ 2 in/min, 77° F.** | |
| $\sigma_m$ (psi) | 84 |
| $\epsilon_m$ (%) | 244 |
| $\epsilon_r$ (%) | 244 |
| $E_0$ (psi) | 1610 |
| **120° F. viscosity (kP)** | |
| $\eta_{0.36}$ | 7 |
| $\eta_{0.008}$ | 12 |
| 120° F. pot life (hr) | ~27–36 |
| **Ballistic properties (with 50/50 90$\mu$/200$\mu$ AP)** | |
| 70-g motor $r_{1000}$ (in/s) | 0.41 |
| 70-g motor n | 0.3 |
| CIV (ft/s) | 806 |
| **NOL card gap** | |
| 1 no-go at 69 cards | |
| **Hazards sensitivity** | |

| | uncured | cured |
|---|---|---|
| impact (cm) | 6.9 | 21 |
| friction ($lb_f$ @ ft/s) | 40 @ 8 | 100 @ 8 |
| ESD (J) | 0.15 | 0.26 |
| FJAI (° C.) | >300 | >300 |

The viscosity of this propellant of 7 kP/12 kP (at 0.36 $s^{-1}$/0.008 $s^{-1}$ shear rates) indicates that it would be easily processible in full-scale mixes. The pot life of approximately 27–36 hours is similar to that of current propellants used in rocket motors requiring multiple full-scale castings.

At 2 in/min, 77° F., the baseline reduced-binder-energy propellant gave $\sigma_m/\epsilon_m/\epsilon_r/E_0$ values of 84 psi/244%/244%/1610 psi (one-pint mix); where am is tensile strength; em is elongation at maximum stress; $\epsilon_r$ is elongation at rupture and $E_0$ is the initial tangent modulus. These properties were tested using JANNAF Class C tensile specimens. Although the abnormally high modulus should not present problems, additional one-pint mixes were made using a diisocyanate, isophorone diisocyanate (IPDI), with N-100 to reduce modulus and achieve even higher elongation. This approach proved to be effective: $\sigma_m/\epsilon_m/\epsilon_r/E_0$ values at 2 in/min, 77° F. went to 113 psi/414%/414%/1280 psi with 80:20 (isocyanate equivalents) N-100:IPDI, and to 88 psi/455%/457%/900 psi with 60:40 N-100:IPDI.

CIV (critical impact velocity) testing, to determine material toughness, was performed on the baseline reduced-binder-energy propellant. The result was 806 ft/s (similar to Trident I C-4 propellants VRP and VTG-5A), indicating low friability.

The appearance of the burning aluminum particles (small, bright) in the microwindow bomb has indicated high combustion efficiency in the reduced-binder-energy propellant. 70-gram motors gave a burn rate at 1000 psi of 0.41 in/s which was higher than predicted by a propellant burn rate model (but this was an empirical model based on HMX-loaded propellants with lower levels of AP). The low slope of 0.3 was not unexpected at this high AP level. This propellant, with 53% AP, should be widely tailorable to adjust burn rate.

EXAMPLE 2

Another binder produced outstanding mechanical properties in an 84%-solids, low hazards (−850 cal/g $Hex_B$) propellant containing 55% coarse (400$\mu$ and 200$\mu$) AP and no bonding agents. This binder also used 6000 molecular weight PTMA. The primary plasticizer in this binder was BUNENA [the BUNENA was diluted slightly (~1:5) with an inert co-plasticizer, TA] and the Pl:Po ratio was 1.0. Although modulus was very high (2530 psi), $\sigma_m$ and $\epsilon_m$ values were also extremely high for a propellant with an energetic binder and such a high level of such coarse solids—104 psi and 174%, respectively @ 2 ipm, 77° F. Properties were demonstrated and verified using a one-pint mixer. This example is also shown in Table III and in Table IV.

This example indicates that relatively small amounts of a variety of energetic plasticizers probably will successfully plasticize high molecular weight PTMA including plasticizers such as triethyleneglycol dinitrate (TEGDN) and butanetriol trinitrate (BTTN) and others.

TABLE III

Reduced-binder-energy formulation with BuNENA/TA plasticizer

| Ingredient | Weight % | | |
|---|---|---|---|
| RS 5 sec NC | 0.04 | Percent Solids | 84 |
| PThA 6000 | 7.23 | P1:Po | 1.00 |
| N-100 | 0.62 | $Hex_8$ (cal/g) | −850 |
| BuNENA | 6.47 | NC/PTMA | 0.005 |
| TA | 1.41 | NCO/OH | 1.3 |
| MNA | 0.23 | theor. $I^0_{sps}$ ($lb_f s/lb_m$) | 261.0 |
| AP (20$\mu$) | 5 | theor. $\rho$ (g/cc) | 1.85 |
| AP (200$\mu$) | 20 | theor. flame T (° K.) | 3712 |
| AP (400$\mu$) | 35 | | |
| Al (30$\mu$) | 22 | | |
| DCDA (dicyandiamide) (<10$\mu$) | 2 | | |
| TPB | (0.01) | | |

TABLE IV

One-pint-mix properties of reduced-binder-energy formulation using BuNENA/TA plasticizer.

| Tensile properties @ 2 in/min, 77° F. | |
|---|---|
| $\sigma_m$ (psi) | 104 |
| $\epsilon_m$ (%) | 174 |
| $\epsilon_r$ (%) | 176 |
| $E_0$ (psi) | 2350 |
| 120° F. viscosity (kP) | |
| $\eta_{0.36}$ | 10 |
| $\eta_{0.008}$ | 29 |

TABLE V

Reduced-binder-energy formulation with mixed NG/TA plasticizer

| Ingredient | Weight % | | |
|---|---|---|---|
| RS 5 sec NC | 0.05 | Percent Solids | 75 |
| PTMA 6000 | 9.88 | P1:Po | 1.26 |
| N-100 | 0.67 | $Hex_8$ (cal/g) | −100 |
| DDI (dimeryl diisocyanate) | 0.26 | NC/PTMA | 0.005 |
| NG | 11.24 | NCO/OH | 1.3 |
| TA | 2.46 | theor. $I^0_{sps}$ ($lb_f$ s/$lb_m$) | 259.7 |
| 2-NDPA | 0.11 | theor. $\rho$ (g/cc) | 1.83 |
| MNA | 0.33 | theor. flame T (° K.) | 3728 |
| AP (20$\mu$) | 8 | | |
| AP (400$\mu$) | 45 | | |
| Al (30$\mu$) | 22 | | |
| TPB | (0.01) | | |

TABLE VI

One-gallon-mix properties of reduced-binder-energy formulation using mixed NG/TA plasticizer.

| Tensile properties @ 2 in/min, 77° F. | |
|---|---|
| $\sigma_m$ (psi) | 79 |
| $\epsilon_m$ (%) | 350 |
| $\epsilon_r$ (%) | 352 |
| $E_0$ (psi) | 799 |
| 120° F. viscosity (kP) | |
| $\eta_{0.36}$ | 3 |
| $\eta_{0.008}$ | 5 |
| 120° F. pot life (hr) | 48 |
| Ballistic properties (one-pound motors) | |
| $r_{1000}$ (in/s) | 0.353 |
| n | 0.29 |

EXAMPLE 3

Another propellant formula which produced excellent mechanical properties is shown in Table V and the one-gallon-mix properties are shown in Table VI. This formula uses an amount of TA along with the NG as plasticizers.

EXAMPLE 4

The formula of this example is shown in Table VII and illustrates a propellant formula that is plasticized with TMETN. This formulation also exhibits excellent mechanical and processing properties as shown in Table VIII.

EXAMPLE 5

The formula and mechanical properties of this example can be seen in Tables IX and X, respectively. In this example, a substantial fraction of the AP oxidizer has been replaced by $NaNO_3$. As with the mixes of previous examples, the mechanical and processing properties were excellent. This mix was also tested for volume resistivity.

TABLE VII

Reduced-binder-energy formulation with TMETN plasticizer

| Ingredient | Weight % | | |
|---|---|---|---|
| RS 5 sec NC | 0.06 | Percent Solids | 75 |
| PTMA 6000 | 11.34 | P1:Po | 1.00 |
| N-100 | 0.78 | $Hex_8$ (cal/g) | −260 |
| IPDI | 0.11 | NC/PTMA | 0.005 |
| TMETN | 12.32 | NCO/OH | 1.3 |
| 2-NDPA | 0.03 | theor. ID ($lb_f s/lb_m$) | 261.0 |
| MNA | 0.36 | theor. ρ (g/cc) | 1.82 |
| AP (20μ) | 10 | theor. flame T (° K.) | 3663 |
| AP (200μ) | 43 | | |
| Al (30μ) | 22 | | |
| TPB | (0.01) | | |

TABLE VIII

One-pint-mix properties of reduced-binder-energy formulation using TMETN plasticizer.

| | |
|---|---|
| Tensile properties @ 2 in/min, 77° F. | |
| $\sigma_m$ (psi) | 134 |
| $\epsilon_m$ (%) | 338 |
| $\epsilon_r$ (%) | 340 |
| $E_0$ (psi) | 1080 |
| 120° F. viscosity (kP) | |
| $\eta_{0.36}$ | 4 |
| $\eta_{0.008}$ | 6 |
| 120° F. pot life (hr) | 50–53 |

TABLE IX

Reduced-binder-energy formulation with AP, Al, and $NaN0_3$ solids

| Ingredient | Weight % | | |
|---|---|---|---|
| RS 5 sec NC | 0.06 | Percent Solid | 74.75 |
| PTMA 6000 | 11.42 | P1:Po | 0.99 |
| N-100 | 0.98 | $Hex_8$ (cal/g) | 0 |
| NG | 12.31 | NC/PTMA | 0.005 |
| 2-NDPA | 0.12 | NCO/OH | 1.3 |
| MNA | 0.36 | theor. $I^0_{sps}$ ($lb_f s/lb_m$) | 245.7 |
| AP (5μ) | 13 | theor. ρ (g/cc) | 1.89 |
| AP (70μ) | 17 | theor. flame T (° K.) | 3732 |

TABLE IX-continued

Reduced-binder-energy formulation with AP, Al, and $NaN0_3$ solids

| Ingredient | Weight % |
|---|---|
| Al (30μ) | 23 |
| $NaNO_3$ (<70μ) | 21.75 |
| TPB | (0.01) |

TABLE X

One-gallon-mix properties of reduced-binder-energy formulation using AP, Al, and $NaN0_3$ solids.

| | |
|---|---|
| Tensile properties @ 2 in/min, 77° F. | |
| $\sigma_m$ (psi) | 244 |
| $\epsilon_m$ (%) | 394 |
| $\epsilon_r$ (%) | 394 |
| $E_0$ (psi) | 1570 |
| 120° F. viscosity (kP) | |
| $\eta_{0.36}$ | 7 |
| $\eta_{0.008}$ | 23 |
| 120° F. pot life (hr) | >35 |
| volume resistivity (ohm-cm) | $1 \times 10^8$ |

This invention has been described herein in considerable detail in order to comply with the Patent Statutes and to provide those skilled in the art with the information needed to apply the novel principles and to construct and use embodiments as required. However, it is to be understood that the invention can be carried out by specifically different formulas and devices and that various modifications can be accomplished without departing from the scope of the invention itself.

What is claimed is:

1. A propellant composition comprising a reduced energy binder, an oxidizer, and a fuel wherein (a) said reduced energy binder includes a high molecular weight polyester polyol binder polymer including an amount of cured poly(1, 4-butanediol adipate) having a molecular weight ($Mw_n$) above 4000 (uncured) and cured using an isocyanate curing agent, and an amount of one or more energetic plasticizers wherein the plasticizer to polymer ratio is less than 1.6:1;

(b) said oxidizer consists of a material selected from the group consisting of ammonium perchlorate and a mixture of ammonium perchlorate and sodium nitrate, and (c) said fuel is aluminum.

2. A propellant composition as in claim 1 wherein said reduced energy binder further comprises an amount of inert plasticizer material.

3. A propellant composition as in claim 2 wherein said inert plasticizer is triacetin.

4. A propellant composition as in claim 1 wherein the one or more energetic plasticizers are selected from the group consisting of nitrate esters of the group consisting of n-butyl-2-nitratoethyl nitramine; trimethylolethane trinitrate; triethyleneglycol dinitrate; butanetriol trinitrate; nitroglycerin and combinations thereof.

5. A propellant composition as in claim 2 wherein the one or more energetic plasticizers are selected from the group consisting of nitrate esters of the group consisting of n-butyl-2-nitratoethyl nitramine; trimethylolethane trinitrate; triethyleneglycol dinitrate; butanetriol trinitrate; nitroglycerin and combinations thereof.

6. A propellant composition as in claim 3 wherein the one or more energetic plasticizers are selected from the group consisting of nitrate esters of the group consisting of n-butyl-2-nitratoethyl nitramine; trimethylolethane trinitrate; triethyleneglycol dinitrate; butanetriol trinitrate; nitroglycerin and combinations thereof.

7. A propellant composition as in claim 4 wherein the plasticizer is selected from the group consisting of nitroglycerin, n-butyl-2-nitratoethyl nitramine, trimethylolethane trinitrate and combinations thereof.

8. A propellant composition as in claim 5 wherein the plasticizer is selected from the group consisting of nitroglycerin, n-butyl-2-nitratoethyl nitramine, trimethylolethane trinitrate and combinations thereof.

9. A propellant composition as in claim 6 wherein the plasticizer is selected from the group consisting of nitroglycerin, n-butyl-2-nitratoethyl nitramine, trimethylolethane trinitrate and combinations thereof.

10. A propellant composition as in claim 9 wherein the plasticizer is trimethylolethane trinitrate.

11. A propellant composition as in claim 1 wherein the poly (1, 4-butanediol adipate) has a molecular weight ($Mw_n$) above 6,000 (uncured).

12. An improved high solid propellant composition comprising by weight:

(a) about 10% cured poly (1, 4-butanediol adipate) having a molecular weight ($Mw_n$)≧6000 (uncured) and cured using an isocyanate curing agent;

(b) about 11% nitroglycerin plasticizer;

(c) about 2.5% triacetin plasticizer;

(d) about 22% aluminum; and (e) about 53% ammonium perchlorate oxidizer.

13. An improved high solids propellant composition comprising by weight:

(a) about 7% cured poly (1, 4-butanediol adipate) having a molecular weight, ($Mw_n$)≧6000 (uncured) and cured using an isocyanate curing agent;

(b) about 6.5% n-butyl-2-nitratoethyl nitramine;

(c) about 1.4% triacetin;

(d) about 22% aluminum;

(e) about 60% ammonium perchlorate; and (f) about 2% dicyandiamide.

14. An improved high solids propellant composition comprising by weight:

(a) about 11% cured poly (1, 4-butanediol adipate) having a molecular weight ($MW_n$) of about 6,000 (uncured) and cured using an isocyanate curing agent;

(b) about 12% plasticizer selected from the group consisting of nitroglycerin and trimethylolethane trinitrate and combinations thereof;

(c) about 22% aluminum; and (d) about 53% ammonium perchlorate.

15. An improved high solids propellant composition comprising by weight:

(a) about 11.3% cured poly (1, 4-butanediol adipate) cured from a tetramethylene adipate prepolymer ($MW_n$) of about 6,200 (uncured) and cured using an isocyanate curing agent;

(b) about 12.2% nitroglycerin plasticizer;

(c) about 22% (30$\mu$) aluminum; and (d) about 53% (200$\mu$) ammonium perchlorate oxidizer.

16. The propellant composition of claim 14 wherein (d) comprises about 30% ammonium perchlorate and about 22% nitrate.

* * * * *